US007189169B2

(12) United States Patent
Billings

(10) Patent No.: US 7,189,169 B2
(45) Date of Patent: Mar. 13, 2007

(54) CUSTOMIZABLE CENTER-OF-GRAVITY GOLF CLUB HEAD

(75) Inventor: David P. Billings, McKinney, TX (US)

(73) Assignee: Dogleg Right Corporation, Dallas, TX (US)

( * ) Notice: Subject to any disclaimer, the term of this patent is extended or adjusted under 35 U.S.C. 154(b) by 0 days.

(21) Appl. No.: 11/313,137

(22) Filed: Dec. 20, 2005

(65) Prior Publication Data

US 2006/0135283 A1 Jun. 22, 2006

Related U.S. Application Data

(63) Continuation of application No. 10/043,421, filed on Jan. 10, 2002, now Pat. No. 7,004,852.

(51) Int. Cl.
*A63B 53/04* (2006.01)

(52) U.S. Cl. ..... 473/332; 473/334; 473/338; 473/339; 473/349

(58) Field of Classification Search ..... 473/324–350, 473/256

See application file for complete search history.

(56) References Cited

U.S. PATENT DOCUMENTS

| | | | |
|---|---|---|---|
| 1,167,106 | A | 1/1916 | Palmer |
| 1,213,382 | A | 1/1917 | Kent |
| 1,453,503 | A | 5/1923 | Holmes |
| 1,526,438 | A | 2/1925 | Scott |
| 1,538,312 | A | 5/1925 | Beat |
| 1,568,888 | A | 1/1926 | Dunn |
| 1,756,219 | A | 4/1930 | Spiker |
| 1,868,286 | A | 7/1932 | Grieve |
| 2,067,556 | A | 1/1937 | Wettlaufer |
| 2,163,091 | A | 6/1939 | Held |
| 2,171,383 | A | 8/1939 | Wettlaufer |
| 2,198,981 | A | 4/1940 | Sullivan |
| 2,214,356 | A | 9/1940 | Wettlaufer |
| 2,225,930 | A | 12/1940 | Sexton |
| 2,328,583 | A | 9/1943 | Reach |
| 2,332,342 | A | 10/1943 | Reach |
| 2,460,445 | A | 2/1949 | Bigler |
| 2,998,254 | A | 8/1961 | Rains et al. |
| 3,075,768 | A | 1/1963 | Karns |
| 3,143,349 | A | 8/1964 | Macintyre |
| 3,466,047 | A | 9/1969 | Rodia et al. |
| 3,606,327 | A | 9/1971 | Gorman |
| 3,610,630 | A | 10/1971 | Glover |
| 3,652,094 | A | 3/1972 | Glover |
| 3,680,868 | A | 8/1972 | Jacob |
| 3,749,408 | A | 7/1973 | Mills |
| 3,897,066 | A | 7/1975 | Belmont |
| 3,976,299 | A | 8/1976 | Lawrence et al. |

(Continued)

FOREIGN PATENT DOCUMENTS

WO WO 2001/066199 A1 9/2001

*Primary Examiner*—Sebastiano Passaniti
(74) *Attorney, Agent, or Firm*—Carr LLP

(57) ABSTRACT

A golf club head that allows a user to customize the location of the center of gravity. The golf club head comprises a club head having a hollow cavity with a weighting port. The weighting port allows a user to place weighting material inside the hollow cavity, customizing the location of the center of gravity, the swing weight, the total weight, and the balance of the golf club.

15 Claims, 3 Drawing Sheets

U.S. PATENT DOCUMENTS 3,979,123 A 9/1976 Belmont
4,008,896 A 2/1977 Gordos
4,085,934 A 4/1978 Churchward
4,180,269 A 12/1979 Thompson
4,214,754 A 7/1980 Zebelean
4,325,553 A 4/1982 Taylor
4,340,230 A 7/1982 Churchward
4,417,731 A 11/1983 Yamada
4,432,549 A 2/1984 Zebelean
4,502,687 A 3/1985 Kochevar
4,607,846 A 8/1986 Perkins
4,655,459 A 4/1987 Antonious
4,754,977 A 7/1988 Sahm
4,811,950 A 3/1989 Kobayashi
4,824,116 A 4/1989 Nagamoto et al.
4,867,458 A 9/1989 Sumikawa et al.
4,869,507 A 9/1989 Sahm
4,895,371 A 1/1990 Bushner
4,927,144 A 5/1990 Stormon
4,944,515 A 7/1990 Shearer
5,013,041 A 5/1991 Sun et al.
5,050,879 A 9/1991 Sun
5,056,705 A 10/1991 Wakita et al.
5,058,895 A * 10/1991 Igarashi ..... 473/341
5,078,400 A 1/1992 Desbiolles et al.
5,082,278 A 1/1992 Hsien
5,184,823 A 2/1993 Desboilles et al.
5,193,806 A 3/1993 Burkly
5,219,408 A 6/1993 Sun
5,244,210 A 9/1993 Au
5,273,283 A 12/1993 Bowland
5,289,865 A 3/1994 Sun
5,316,298 A 5/1994 Hutin et al.
5,322,285 A 6/1994 Turner
5,351,958 A 10/1994 Helmstetter
5,385,348 A 1/1995 Wargo
5,407,202 A 4/1995 Igarashi
5,447,309 A 9/1995 Vincent
5,482,282 A 1/1996 Willis
5,518,243 A 5/1996 Redman
5,522,593 A 6/1996 Kobayashi et al.
5,533,730 A 7/1996 Ruvang
5,558,226 A 9/1996 Fritz
5,570,886 A * 11/1996 Rigal et al. ..... 473/345
5,746,664 A 5/1998 Reynolds, Jr.
5,755,624 A 5/1998 Helmstetter
5,766,092 A 6/1998 Mimeur et al.
5,797,807 A 8/1998 Moore
5,851,160 A * 12/1998 Rugge et al. ..... 473/349
5,855,525 A 1/1999 Turner
5,911,638 A 6/1999 Parente et al.
5,913,735 A 6/1999 Kenmi
5,947,840 A 9/1999 Ryan
5,961,394 A 10/1999 Minabe
6,001,024 A 12/1999 Van Alen, II et al.
6,015,354 A 1/2000 Ahn et al.
6,030,295 A 2/2000 Takeda
6,089,994 A 7/2000 Sun
6,206,790 B1 3/2001 Kubica et al.
6,248,025 B1 6/2001 Murphy et al.
6,254,494 B1 7/2001 Hasebe et al.
6,290,609 B1 9/2001 Takeda
6,306,048 B1 10/2001 McCabe et al.
6,309,311 B1 10/2001 Lu
6,315,678 B1 11/2001 Teramoto
6,364,788 B1 4/2002 Helmstetter et al.
6,443,851 B1 9/2002 Liberatore
6,458,044 B1 10/2002 Vincent et al.
6,514,154 B1 2/2003 Finn
6,648,772 B2 11/2003 Vincent et al.
6,716,111 B2 4/2004 Liberatore
6,923,734 B2 8/2005 Meyer
6,991,558 B2 * 1/2006 Beach et al. ..... 473/324
7,004,852 B2 * 2/2006 Billings ..... 473/332
7,147,570 B2 12/2006 Toulon et al.
2002/0137576 A1 9/2002 Dammen

* cited by examiner

CUSTOMIZABLE CENTER-OF-GRAVITY GOLF CLUB HEAD

CROSS-REFERENCE TO RELATED APPLICATIONS

This application is a continuation of, and claims the benefit of the filing date of, U.S. patent application Ser. No. 10/043,421 entitled CUSTOMIZABLE CENTER-OF-GRAVITY GOLF CLUB HEAD, filed Jan. 10, 2002 now U.S. Pat. No. 7,004,852.

FIELD OF THE INVENTION

The invention relates generally to golf clubs and, more particularly, to a golf club head in which the center of gravity, balance, and weight are customizable and can be altered to suit changing course conditions, weather conditions, and other user requirements.

BACKGROUND OF THE INVENTION

Golfers have long recognized that they could alter the weight, balance, and performance characteristics by selectively adding weight to club heads. Typically, weight is added by applying thin strips of lead tape with an adhesive backing to the club head. In this manner the swing weight is increased and the center of gravity (CG) is altered to change the dynamics of the head during the swing and, therefore, the ball flight characteristics after contact. The location of the lead tape, however, is generally limited to the back, crown, and sole of the club heads, where it would best stay affixed and not alter the look of the club. However, this limits the adjustability options available to the golfer. For example, the lead tape can not be put on the face of the club to move the CG closer to the front of the club. Forward movement of the center of gravity is more desirable to some golfers who want the club to be easier to "work", that is, to shape shots both in a left-to-right manner and in a right-to-left manner.

Furthermore, use of lead tape is generally an additive process, increasing the swing weight and total weight of the club was increased and oftentimes negatively affecting other performance characteristics of the club. Some golfers attempt to overcome this obstacle by grinding down or using other means to reduce the weight of the club. However, this often damages the protective finish of the club or the shape and configuration intended by the club designer, negatively affects the after market value of the club, and is both difficult and time-consuming for the golfer to adjust.

Furthermore, manufacturers of golf clubs have encountered problems manufacturing individual clubs to identical specifications, because of variances of the individual components themselves and when assembled together. Generally, manufacturers build clubs to a weight at, or slightly below, a targeted weight specification and then add additional weight to either or both of the head and the shaft, as desired, to increase either or both of the total weight and the swing weight to the desired specification. Additional weight is commonly added by pouring lead powder into the bottom of the shaft and sealing the shaft with a cork or other means. Alternatively, lead powder is mixed with putty, epoxy, or other materials that are inserted into the end of the shaft of the assembled head and shaft to facilitate this final weight adjustment by the manufacturer. These methods, however, may alter the CG of the club away from the optimal location, adversely effecting performance and feel.

Additionally, a common practice is to inject a hot melt glue or similar material into a hole in the club head during final assembly to arrive at a prescribed swing weight. The location that the glue puddles and adheres to the inner walls is determined by the orientation of the head while the glue is still hot and fluid. This technique is also used to customize the center of gravity of the club head for specific golfers' needs. The location of the glue, however, is generally limited to one broad area due to the closed process, and once the glue is set, the glue is not adjustable.

Therefore, there is a need for a golf club head with a customizable CG that allows the CG to be altered by either or both the golfer and the manufacturer, both prior to and following final manufacture.

SUMMARY

The present invention provides a golf club that allows a user to customize the location of the center of gravity. The golf club comprises club head having a hollow cavity with a weighting port that allows the user to access the cavity. The weighting port allows a user to place weighting material inside the golf club head, thereby adjusting or customizing the location of the center of gravity.

BRIEF DESCRIPTION OF THE DRAWINGS

For a more complete understanding of the present invention, and the advantages thereof, reference is now made to the following description taken in conjunction with the accompanying drawings, in which.

DETAILED DESCRIPTION

Figure 1:
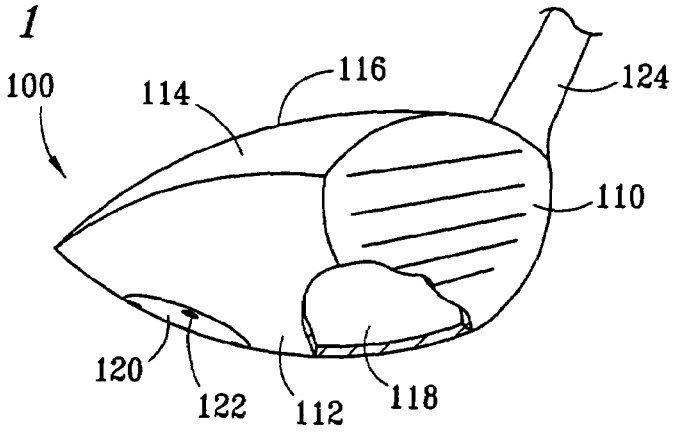
FIG. 1 illustrates a metal golf club head that embodies features of the present invention.

Referring to FIG. 1 of the drawings, the reference numeral 100 generally designates a hollow golf club head embodying features of the present invention. The hollow golf club head 100 generally comprises a face portion 110, a sole and wall portion 112, and a crown portion 114 defining a housing or body 116 with an interior cavity 118. A hosel portion 124 is connected to and/or integrated into the body 116 for receiving a shaft (not shown). A removable port cover 120 provides access to the interior cavity 118, allowing placement of weighting material, such as lead tape, into the interior cavity 118.

In the preferred embodiment, the hollow golf club head 100 comprises a two-piece golf club head. The first piece comprises the sole and wall portion 112 and the face portion 110, including the hosel portion 124. The second piece comprises the crown portion 114, which is welded or otherwise attached to the first piece. The present invention is not limited, however, to use with any particular construction of a golf club head, and may be utilized in single-piece and three-piece heads, as well as club heads constructed from any number of pieces.

Figure 2:
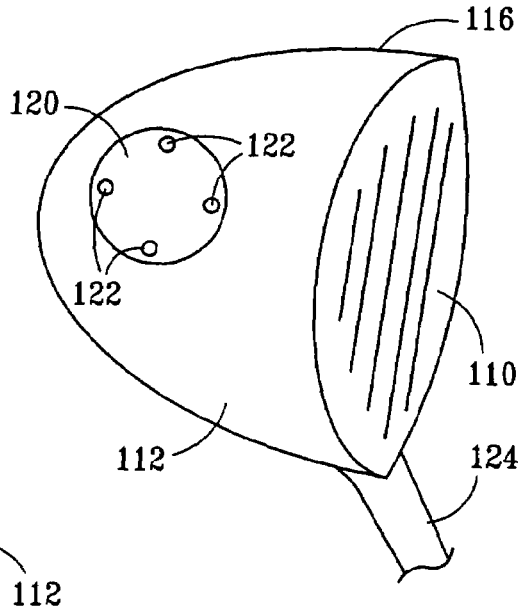
FIG. 2 illustrates a bottom view of a metal golf club head that embodies features of the present invention.

FIG. 2 is a bottom view of the hollow golf club head 100, further illustrating the positioning and sizing of the weighting-port cover 120 in the preferred embodiment. Preferably, the weighting-port cover 120 is positioned on the bottom or sole of the hollow golf club head 100 and away from the face portion 110. The weighting-port cover 120 is preferably positioned such that the weighting-port cover 120 is not visible by a golfer when addressing a golf ball. Furthermore, the placement of the weighting-port cover 120 away from the face portion 110 allows placement of weighting material about, or on, the interior side of the face portion 110, and along the heal and toe portions of the hollow golf club head 100.

The weighting port cover 120 is preferably attached to the body 116 via a plurality of flush-mounted bolts 122, and, optionally, may be coated with a friction-reducing material, such as Teflon. In order to reduce the friction, the possibility of the weighting-port cover "snagging" on grass, thereby affecting the swing path, and the associated wear and tear, the weighting-port cover 120 is flush-mounted to the sole and wall portion 112 by the plurality of flush-mounted bolts 122.

Figure 3:
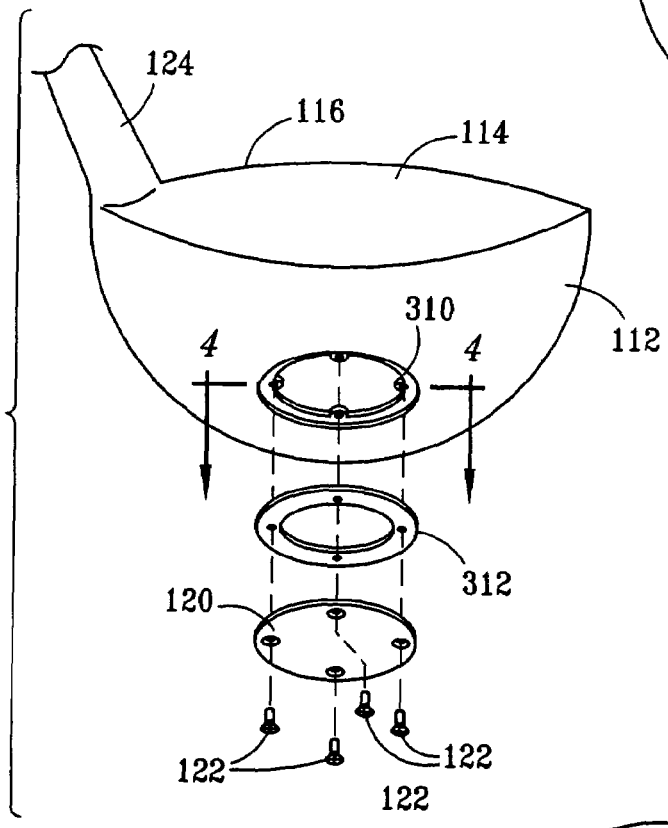
FIG. 3 illustrates a rear view of a metal golf club head with a weighting port cover removed that embodies features of the present invention.

FIG. 3 illustrates the hollow golf club head 100 with the weighting-port cover 120 removed. The body 116 preferably includes a recessed portion 310 configured for receiving an optional vibration-dampening ring 312 and the weighting-port cover 120. The vibration-dampening ring 312, such as a ring made from foam, rubber, and/or the like, allows the weighting-port cover 120 to be securely fastened, preventing a vibration or rattling noise that may occur as a result of swinging the club, moving the club, or striking a ball. The vibration-dampening ring 312 also seals the interior cavity 118 from exposure to outside elements, such as sand, water, or the like.

The plurality of flush-mounted bolts 122 pass through the weighting-port cover 120 and screw into the recessed portion 310 of the body 116. Alternatively, other means and methods of attaching the weighting-port cover 120 may be used, such as a weighting-port cover that screws into the body 116, latches, press-fits, or the like. The preferred embodiment utilizes a weighting-port cover 120 that is curved to match the contour of the body.

Figure 4:
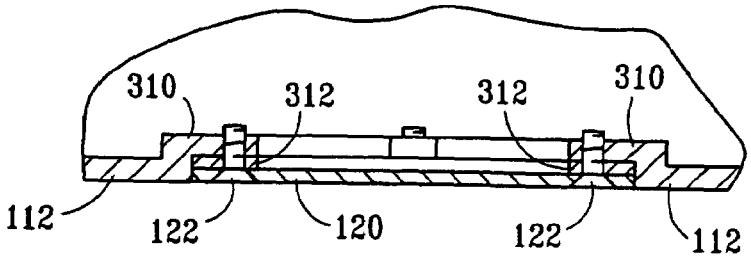
FIG. 4 illustrates a cross-section view with the weighting port cover attached that embodies features of the present invention.

FIG. 4 illustrates a side view of the weighting-port cover 120 attached to the body 116 in accordance the embodiment of the present invention depicted in FIG. 3. As one skilled in the art will appreciate, the recessed portion 310 allows a flush mounting and a smooth contour to be formed when the sole and wall portion 112 and the weighting-port cover 120 are assembled. Alternatively, the weighting-port cover 120 could be recessed from the sole and wall portion, if desired.

Figure 5:
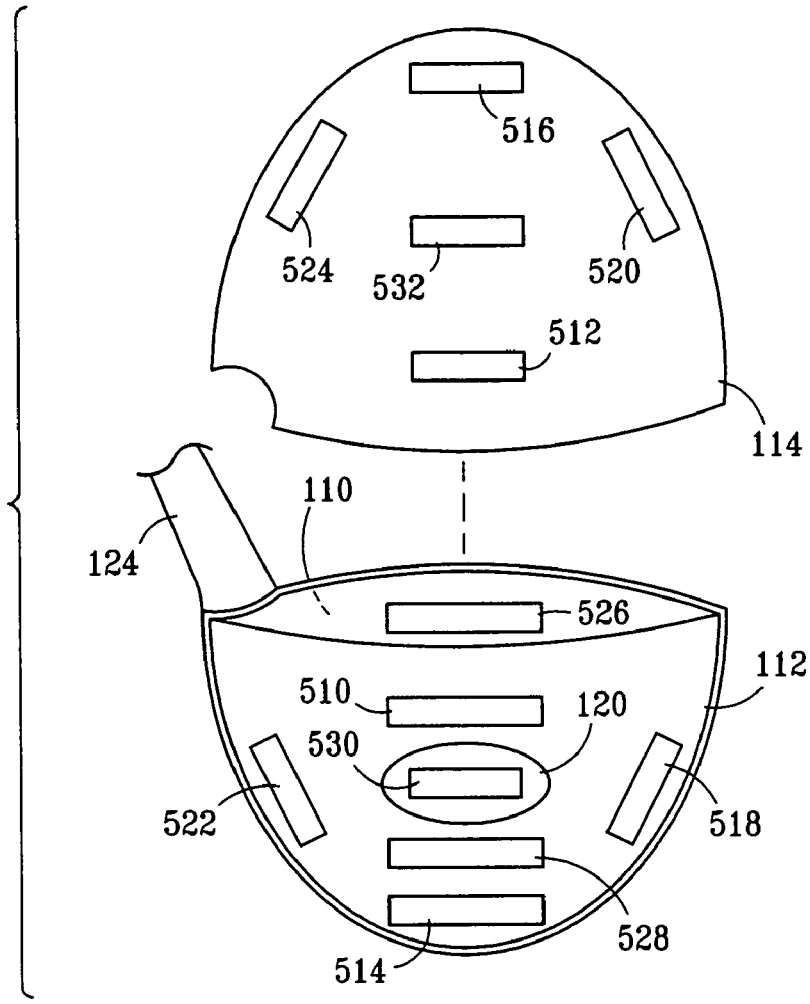
FIG. 5 illustrates a metal golf club head with the crown portion removed to indicate some positions of weighting material.

FIG. 5 illustrates the hollow golf club head 100 with the crown portion 114 separated from the sole and wall portion 112 and rotated to face the inner wall towards the reader in order to illustrate potential placements of weighting material in accordance with embodiments of the present invention. The illustrated positions are presented for illustrative purposes only and, therefore, should not limit the present invention in any manner. Furthermore, the positions shown may be used individually or in combination to further customize the location of the center of gravity.

Weight location 510 illustrates a low-front-center location, which is located on the integrated sole and wall portion 112 adjacent to the face portion 110, that tends to impart less spin on the ball and a higher trajectory, resulting in easier workability (the ability to hit the ball from left to right and vice versa) and more carry (the distance the ball travels in the air).

Weight location 512 illustrates a high-front-center location, which is located on the crown portion 114 adjacent to the face portion, that tends to impart less spin on the ball and a lower trajectory, resulting in easier workability, less carry, and more rolling.

Weight location 514 illustrates a low-back-center location, which is located on the back-center of the sole and wall portion 112, that tends to result in more forgiveness and a higher trajectory.

Weight location 516 illustrates a high-back-center location, which is located on the back-center of the crown portion 114, that tends to result in more forgiveness and a lower trajectory.

Weight location 518 illustrates a low-back-toe location, which is located on the back-center of the integrated sole and wall portion 112 along the toe, that tends to result in more forgiveness and a higher, fading trajectory.

Weight location 520 illustrates a high-back-toe location, which is located on the back-center of the crown portion 114 along the toe, that tends to result in more forgiveness and a lower, fading trajectory.

Weight location 522 illustrates a low-back-heel location, which is located on the back-center of the integrated sole and wall portion 112 along the heel, that tends to result in more forgiveness and a higher, drawing trajectory.

Weight location 524 illustrates a high-back-heel location, which is located on the back-center of the crown portion 114 along the heel, that tends to result in more forgiveness and a lower, drawing trajectory.

Weight location 526 illustrates a forward-center-center location, which is located on the center of the face portion 110, that tends to result in easier workability with a neutral trajectory.

Weight location 528 illustrates a back-center-center location, which is located in the vertical-center of the integrated sole and wall portion 112, that tends to result in neutrally forgiving club head.

Weight location 530 illustrates a low-center-center location, which is located on the center of the integrated sole and wall portion 112, that tends to result in a neutral side-spin with a higher trajectory. Note that this location is located on the weighting-port cover 120 for illustrative purposes only. As stated above, the weighting-port cover 120 may be located at any desired location, and a weight may be placed on the weighting-port cover 120 if so desired.

Weight location 532 illustrates a high-center-center location, which is located in the center of the crown portion 114, that tends to result in a neutral side-spin with a lower trajectory.

Figure 6:
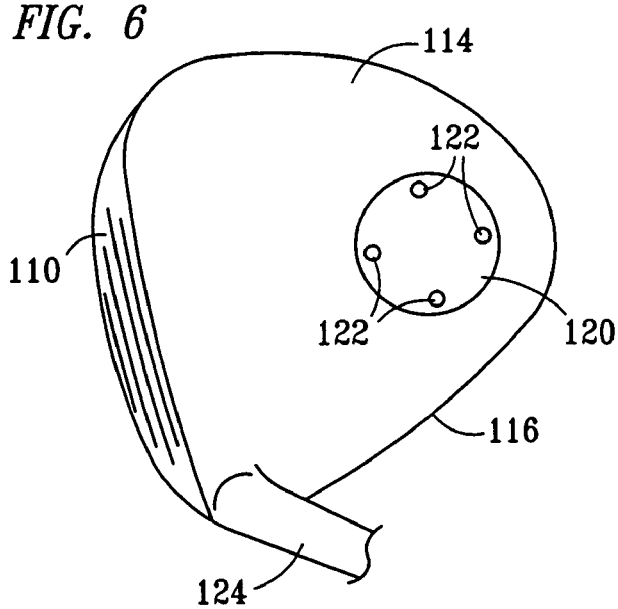
FIG. 6 illustrates a metal driver head embodying features of the present invention.

FIG. 6 illustrates a driver golf club head embodying features of the present invention in which the weighting-port cover 120 is located on the crown portion 114.

Figure 7:
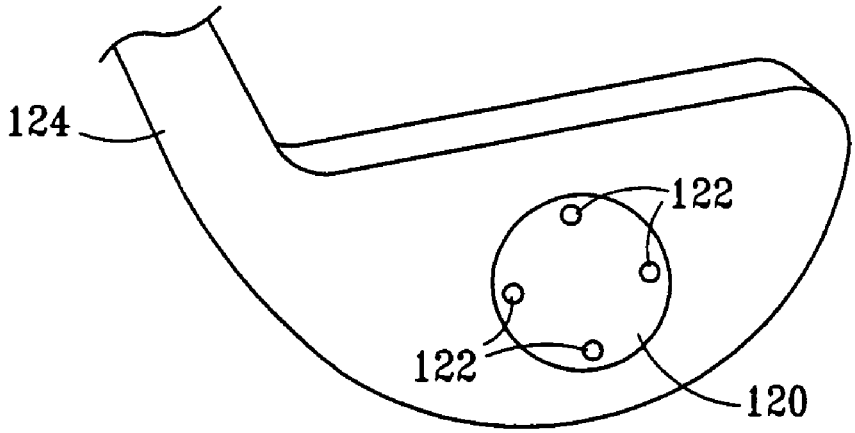
FIG. 7 illustrates a metal iron golf club head embodying features of the present invention.

FIG. 7 illustrates a hollow, iron golf club head embodying features of the present invention in which a weighting-port cover 710 is provided.

Figure 8:
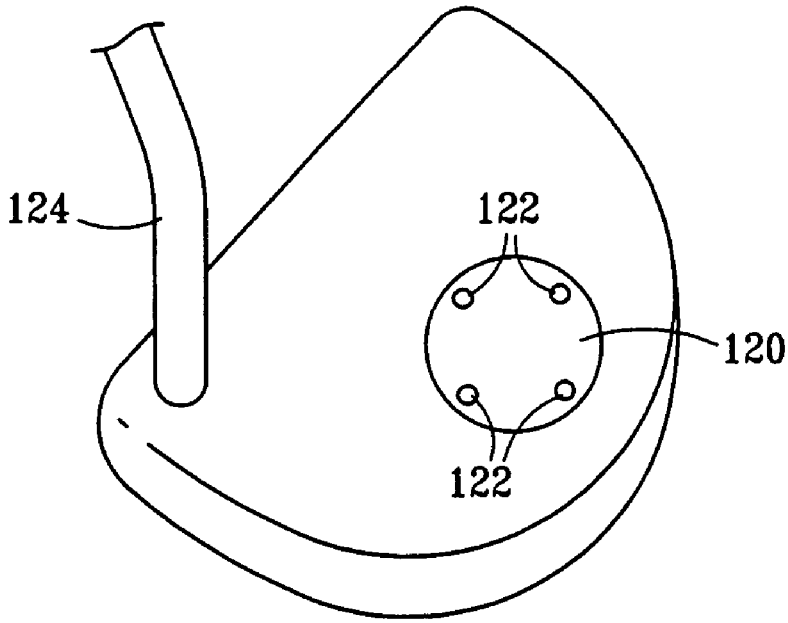
FIG. 8 illustrates a metal putter head embodying features of the present invention.

FIG. 8 illustrates a hollow, putter golf club head embodying features of the present invention in which a weighting-port cover 810 is provided.

It should be noted that the placement and size of the weighting port is shown for illustrative purposes only, and, therefore, should not limit the present invention in any manner.

It is understood that the present invention can take many forms and embodiments. Accordingly, several variations may be made in the foregoing without departing from the spirit or the scope of the invention. For example, the weighting port may be of a different shape and/or there may be a different method of accessing the interior of the club head, such as removing the sole of the club head, the back of the club head, or the like.

Having thus described the present invention by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Many such variations and modifications may be considered obvious and desirable by those skilled in the art based upon a review of the foregoing description of preferred embodiments. Accordingly, it is appropriate that the appended claims be construed broadly and in a manner consistent with the scope of the invention.

The invention claimed is:

1. A golf club head comprising:

a relatively thin shell having a plurality of walls that collectively form a hollow club head body comprising a front club head portion having a wall for striking a golf ball, a back club head portion and an original center of gravity prior to addition of any weights;

at least four weights readily user-repositionably secured to said shell of said club head at readily user-accessible spaced-apart locations along the walls of the shell to adjust the center of gravity of the golf club head body;

wherein at least one of said weights is securable in a location that is substantially non-co-linear with the others of said weights to permit adjustment of the center of gravity of the golf club head in at least two axes;

wherein at least a portion of one of said weights is user-repositionably disposed behind and to the heel side of said original center of gravity;

wherein at least a portion of one of said weights is user-repositionably disposed behind and to the toe side of said original center of gravity;

wherein at least a portion of each of two of said weights is user-repositionably disposed in front of said original center of gravity; and wherein each of said weights is interchangeably repositionable by the user at each of said locations.

2. The golf club head defined in claim 1 further comprising:

a recess in said body, and wherein at least one of said weights is attached to a member disposed in said recess and detachably and user-accessibly screwably attached to said body.

3. The golf club head defined in claim 1, wherein at least a portion of one of said weights is attached to a member detachably and user-accessibly attached to said body.

4. The golf club head defined in claim 3, wherein said member is readily accessible for screwable attachment and detachment from outside the shell.

5. The golf club head defined in claim 3, wherein said member is screwably attached to said body.

6. The golf club head defined in claim 4, wherein substantially all of said weight attached to said screwably attached member is generally close to but inside a plane defined by the walls that are in the vicinity of said recess.

7. The golf club head defined in claim 1, wherein there is at least one recess in said shell and wherein said member is attached by at least partially inserting the member into said recess in the shell such that the weight attached to the member is disposed at least partially inside a plane defined by adjacent portions of the shell.

8. The golf club head defined in claim 1 further comprising:

a recess in said body; and wherein at least one of said weights is attached to a member disposed in said recess and detachably and user-accessibly screwably attached to said body.

9. A golf club head comprising:

a relatively thin shell comprising a plurality of walls that collectively form a hollow body with a substantially empty or voided cavity;

said club head having a port defined therein;

a plurality of weights detachably secured to said shell of said club head at readily user-accessible spaced-apart locations along the walls of the shell;

a first one of said plurality of weights being located at the port;

a second one of said weights being located near a rear of the club head, left of a center-line of the head;

a third one of said weights being located near the rear of the club head, right of the center-line of the head;

a fourth one of said weights being located near the front of said club head; and each of said weights being accessible to a user, and each of said plurality of weights being detachable from, and detachably-securable to, the club head by the user for shifling the center of gravity of the golf club head in the general directions of at least two non-parallel axes.

10. The golf club head of claim 9, further comprising a port attachment member for detachably securing the first one of said plurality of weights to the port and the club head.

11. The golf club head of claim 9, further comprising a threaded coupling for detachably securing the first one of said plurality of weights to the port and the club head.

12. The golf club head of claim 9, wherein each of said plurality of weights being detachable from, and detachably-securable to, the club head by the user for shifting the center of gravity of the golf club head in the general directions of at least three non-parallel axes.

13. A golf club, comprising:

a club head comprised of a relatively thin shell, the thin shell comprised of a plurality of walls that collectively form a hollow body with a substantially empty or voided cavity, the club head including a face for striking a golf ball, a heel portion, a toe portion and a back portion, the club head having a first axis extending between the heel and the toe portions and a second axis extending between the face and the back portion of the club head;

a plurality of discrete weights user-detachably secured to the shell of the club head at readily user-accessible, spaced-apart locations along the walls of the shell in a plurality of arrangements, said plurality of arrangements being user-selectable after manufacture of the club head by detaching and detachably securing any of the plurality of weights to the club head, the weights extending inwardly of the outer surface of the shell when detachably secured to the club head in any of the plurality of arrangements; and the club head having a center of gravity, the center of gravity shifting generally in the directions of the first and second axes upon changing the arrangement of the plurality of weights between the first and second plurality of arrangements; and wherein locations along the walls of the shell, further comprise:

a first location near a rear of the club head, to the toe side of a center-line of the club head;

a second location near the rear of the club head, to the heel side of the center-line of the club head;

a third location nearer the face of the club head than the rear of the club head; and a fourth location nearer the face of the club head than the rear of the club head.

14. A golf club, comprising:

a club head comprised of a relatively thin shell, the thin shell comprised of a plurality of walls that collectively form a hollow body with a substantially empty or voided cavity, the club head including a face for striking a golf ball, a heel portion, a toe portion and a back portion, the club head having a first axis extending between the heel and the toe portions and a second axis extending between the face and the back portion of the club head;

a plurality of discrete weights user-detachably secured to the shell of the club head at readily user-accessible, spaced-apart locations along the walls of the shell in a plurality of arrangements, said plurality of arrangements being user-selectable after manufacture of the club head by detaching and detachably securing any of the plurality of weights to the club head, the weights extending inwardly of the outer surface of the shell when detachably secured to the club head in any of the plurality of arrangements;

a port defined in the shell of the club head;

a member coupling one of the plurality of weights to the club head at the port; and the club head having a center of gravity, the center of gravity shifting generally in the directions of the first and second axes upon changing the arrangement of the plurality of weights between the first and second plurality of arrangements.

15. A golf club, comprising:

a club head comprised of a relatively thin shell, the thin shell comprised of a plurality of walls that collectively form a hollow body with a substantially empty or voided cavity, the club head including a face for striking a golf ball, a heel portion, a toe portion and a back portion, the club head having a first axis extending between the heel and the toe portions and a second axis extending between the face and the back portion of the club head;

a plurality of discrete weights user-detachably secured to the shell of the club head at readily user-accessible, spaced-apart locations along the walls of the shell in a plurality of arrangements, said plurality of arrangements being user-selectable after manufacture of the club head by detaching and detachably securing any of the plurality of weights to the club head, the weights extending inwardly of the outer surface of the shell when detachably secured to the club head in any of the plurality of arrangements; and the club head having a center of gravity, the center of gravity shifting generally in the directions of the first and second axes upon changing the arrangement of the plurality of weights between the first and second plurality of arrangements; and a port defined in the shell of the club head, wherein one of the plurality of weights is threadably coupled to the club head at the port.

* * * * *

UNITED STATES PATENT AND TRADEMARK OFFICE

CERTIFICATE OF CORRECTION

PATENT NO. : 7,189,169 B2
APPLICATION NO. : 11/313137
DATED : March 13, 2007
INVENTOR(S) : David P. Billings It is certified that error appears in the above-identified patent and that said Letters Patent is hereby corrected as shown below:

Title page item 56 References Cited, Page 2, "5,050,879 A 9/1991 Sun" should be changed to --5,050,879 A 9/1991 Sun et al.--

Column 6, Line 36, for the claim reference number "9", "shifling" should be changed to --shifting--

Signed and Sealed this

Fifteenth Day of May, 2007

JON W. DUDAS
*Director of the United States Patent and Trademark Office*

US007189169C1

(12) INTER PARTES REEXAMINATION CERTIFICATE (647th)

United States Patent
Billings

(10) Number: US 7,189,169 C1
(45) Certificate Issued: Jul. 23, 2013

(54) CUSTOMIZABLE CENTER-OF-GRAVITY GOLF CLUB HEAD

(75) Inventor: David P. Billings, McKinney, TX (US)

(73) Assignee: Dogleg Right Corporation, Dallas, TX (US)

Reexamination Request:
No. 95/000,362, Apr. 7, 2008

Reexamination Certificate for:

| | |
|---|---|
| Patent No.: | **7,189,169** |
| Issued: | **Mar. 13, 2007** |
| Appl. No.: | **11/313,137** |
| Filed: | **Dec. 20, 2005** |

Certificate of Correction issued May 15, 2007

Related U.S. Application Data

(63) Continuation of application No. 10/043,421, filed on Jan. 10, 2002, now Pat. No. 7,004,852.

(51) Int. Cl.
*A63B 53/04* (2006.01)

(52) U.S. Cl.
USPC ..... 473/332; 473/334; 473/338; 473/339; 473/349

(58) Field of Classification Search
None
See application file for complete search history.

(56) References Cited

To view the complete listing of prior art documents cited during the proceeding for Reexamination Control Number 95/000,362, please refer to the USPTO's public Patent Application Information Retrieval (PAIR) system under the Display References tab.

*Primary Examiner* — Cary E. Wehner

(57) ABSTRACT

A golf club head that allows a user to customize the location of the center of gravity. The golf club head comprises a club head having a hollow cavity with a weighting port. The weighting port allows a user to place weighting material inside the hollow cavity, customizing the location of the center of gravity, the swing weight, the total weight, and the balance of the golf club.

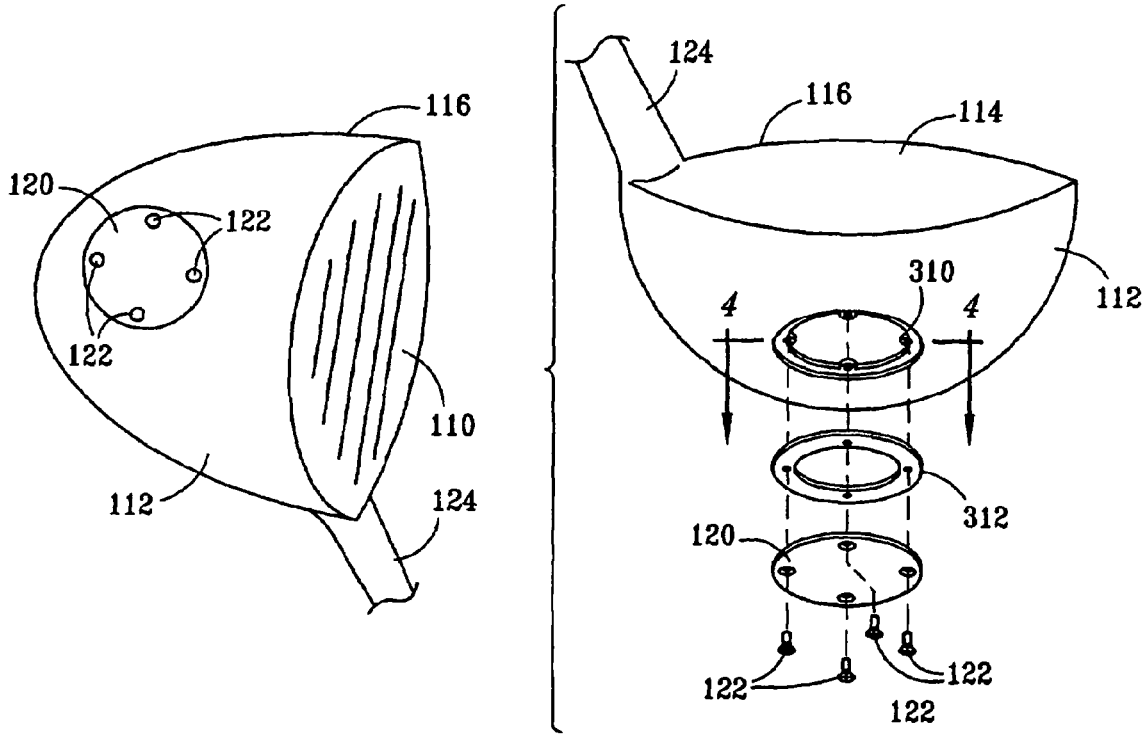

INTER PARTES REEXAMINATION CERTIFICATE ISSUED UNDER 35 U.S.C. 316

THE PATENT IS HEREBY AMENDED AS INDICATED BELOW.

AS A RESULT OF REEXAMINATION, IT HAS BEEN DETERMINED THAT:

Claims 1-15 are cancelled.

* * * * *